US011261397B2

(12) United States Patent
Hamashima

(10) Patent No.: US 11,261,397 B2
(45) Date of Patent: Mar. 1, 2022

(54) LUBRICANT COMPOSITION FOR PLASTIC PROCESSING

(71) Applicant: MORESCO CORPORATION, Hyogo (JP)

(72) Inventor: Kentaro Hamashima, Hyogo (JP)

(73) Assignee: MORESCO CORPORATION, Hyogo (JP)

( * ) Notice: Subject to any disclaimer, the term of this patent is extended or adjusted under 35 U.S.C. 154(b) by 0 days.

(21) Appl. No.: 16/759,933

(22) PCT Filed: Sep. 10, 2018

(86) PCT No.: PCT/JP2018/033441

§ 371 (c)(1),
(2) Date: Apr. 28, 2020

(87) PCT Pub. No.: WO2019/087573

PCT Pub. Date: May 9, 2019

(65) Prior Publication Data

US 2020/0277539 A1 Sep. 3, 2020

(30) Foreign Application Priority Data

Nov. 1, 2017 (JP) ..... JP2017-212134

(51) Int. Cl.

| | |
|---|---|
| ***C10M 141/02*** | (2006.01) |
| ***C10M 125/26*** | (2006.01) |
| ***C10M 129/34*** | (2006.01) |
| ***C10M 129/52*** | (2006.01) |
| ***C10M 173/02*** | (2006.01) |
| ***C10M 173/00*** | (2006.01) |
| ***C10N 40/20*** | (2006.01) |
| ***C10N 10/02*** | (2006.01) |

(52) U.S. Cl.

CPC ..... *C10M 141/02* (2013.01); *C10M 125/26* (2013.01); *C10M 129/34* (2013.01); *C10M 129/52* (2013.01); *C10M 173/00* (2013.01); *C10M 173/02* (2013.01); *C10M 2201/102* (2013.01); *C10M 2201/105* (2013.01); *C10M 2207/123* (2013.01); *C10M 2207/142* (2013.01); *C10M 2209/12* (2013.01); *C10N 2010/02* (2013.01); *C10N 2040/246* (2020.05)

(58) Field of Classification Search

CPC ..... C10M 125/26; C10M 129/34; C10M 129/52; C10M 141/02; C10M 173/00; C10M 173/02; C10M 2201/102; C10M 2201/103; C10M 2201/105; C10M 2205/026; C10M 2207/123; C10M 2207/142; C10M 2209/084; C10M 2209/12; C10N 2010/02; C10N 2030/06; C10N 2040/242; C10N 2040/245; C10N 2040/246

See application file for complete search history.

(56) References Cited

U.S. PATENT DOCUMENTS

| | | | | |
|---|---|---|---|---|
| 3,375,193 | A * | 3/1968 | Ruzza et al. | C10M 173/02 508/121 |
| 4,294,853 | A * | 10/1981 | Williams | C10M 141/08 514/566 |
| 4,346,148 | A * | 8/1982 | Jahnke | C07F 9/1411 428/461 |
| 4,454,050 | A * | 6/1984 | Bertell | C10M 173/02 508/219 |
| 4,882,077 | A * | 11/1989 | Cox | C10M 159/04 508/463 |
| 9,206,378 | B2 * | 12/2015 | Okuda | C10M 169/04 |
| 2010/0043301 | A1 * | 2/2010 | Yoon | C10M 173/02 51/298 |
| 2012/0083432 | A1 | 4/2012 | Hatasaki et al. | |
| 2014/0087981 | A1 * | 3/2014 | Okuda | C10M 169/04 508/161 |
| 2018/0148660 | A1 * | 5/2018 | Kozaki | C10M 125/30 |

FOREIGN PATENT DOCUMENTS

| | | |
|---|---|---|
| JP | 02-006600 | 1/1990 |
| JP | 06-212184 | 8/1994 |
| JP | 08-311468 | 11/1996 |
| JP | 11-228980 | 8/1999 |
| JP | 2005-036070 | 2/2005 |
| JP | 4140960 | 8/2008 |
| JP | 04256703 | 4/2009 |
| JP | 04659220 | 3/2011 |
| JP | 2015-117345 | 5/2015 |
| JP | 05718944 | 5/2015 |

(Continued)

OTHER PUBLICATIONS

International Preliminary Report on Patentability for PCT/JP2018/033441, dated May 14, 2020, 8 pages.
International Search Report for PCT/JP2018/033441, dated Dec. 11, 2018,2 pages.
Office Action for CN Patent Application No. 201880070498.5, dated Oct. 27, 2021, 7 pages.

* cited by examiner

*Primary Examiner* — James C Goloboy

(74) *Attorney, Agent, or Firm* — Casimir Jones, SC; Robert A. Goetz

(57) ABSTRACT

Provided is a lubricant composition for plastic working which lubricant composition is excellent in lubricity and mold releasability. The lubricant composition for plastic working which lubricant composition contains: (a) silica; and (b) an alkali metal salt of an organic acid, a weight ratio of (b) the alkali metal salt of the organic acid to (a) the silica (a weight of (b)/a weight of (a)) being not less than 2, is used.

8 Claims, No Drawings

(56) References Cited

FOREIGN PATENT DOCUMENTS

| | | | | |
|---|---|---|---|---|
| JP | 2016-079277 | | 5/2016 | |
| WO | 2000/053705 | | 9/2000 | |
| WO | WO-0053705 | A1 * | 9/2000 | ..... C10M 125/00 |
| WO | 2011/001653 | | 1/2011 | |
| WO | 2012/086564 | | 6/2012 | |
| WO | 2012/144457 | | 10/2012 | |
| WO | WO-2016185876 | A1 * | 11/2016 | ..... C10M 125/18 |

LUBRICANT COMPOSITION FOR PLASTIC PROCESSING

TECHNICAL FIELD

The present invention relates to a lubricant composition for plastic working.

BACKGROUND ART

Generally, in a case where workpiece materials, such as carbon steel, alloy steel, and non-ferrous metal, are subjected to plastic working involving molds, such as forging, rolling, wire drawing, and extrusion, in warm regions or hot regions, lubricants are used to improve lubricity and mold releasability between the molds and the workpiece materials.

As such lubricants, graphite-based lubricants for plastic working, in which graphite is dispersed in oil or water, have been conventionally used. The graphite-based lubricants for plastic working are excellent in lubricity and mold releasability. However, the graphite-based lubricants have a problem that the graphite-based lubricants contaminate working environments in black, because the graphite-based lubricants contain graphite.

Therefore, in recent years, developments of lubricants for plastic working which do not contain graphite (that is, non-graphite-based lubricants for plastic working) and which are comparable in property to graphite-based lubricant compositions for plastic working are demanded.

As such a non-graphite-based lubricant for plastic working, Patent Literature 1 discloses a lubricant composition for plastic working which lubricant composition contains a silica-alumina hollow body and which lubricant composition is excellent in heat insulating property.

Patent Literature 2 discloses a lubricant composition for hot rolling for a steel material or a steel strip, which lubricant composition is composed of a solid lubricant, a surfactant, and water and which lubricant composition contains water glass and the like together with the solid lubricant.

Patent Literature 3 discloses that use of a lubricant composition for plastic working which lubricant composition contains a layered clay mineral such as smectite allows control of generation of a film residue which causes defective molding.

CITATION LIST

Patent Literature

[Patent Literature 1]

International Publication No. WO 2000/053705 (published on Sep. 14, 2000)

[Patent Literature 2]

Japanese Patent Application Publication Tokukai No. 2005-36070 (published on Feb. 10, 2005) [Patent Literature 3]

International Publication No. WO 2012/086564 (published on Jun. 28, 2012)

SUMMARY OF INVENTION

Technical Problem

However, a non-graphite-based lubricant for plastic working as described above has further room for improvement, from the viewpoint of providing a lubricant for plastic working which lubricant is comparable in lubricity and mold releasability to a graphite-based lubricant for plastic working.

Under the circumstances, an object of an embodiment of the present invention is to provide a non-graphite-based lubricant composition for plastic working which lubricant composition is excellent in lubricity and mold releasability.

Solution to Problem

The inventors of the present invention conducted diligent studies in order to attain the object, and consequently found that, by using a lubricant composition for plastic working which lubricant composition contains silica and an alkali metal salt of an organic acid at a specific weight ratio, it is possible to provide a lubricant composition for plastic working which lubricant composition is excellent in lubricity and mold releasability. As a result, the inventors of the present invention completed the present invention.

That is, the present invention includes the following.

[1] A lubricant composition for plastic working, containing:
(a) silica; and
(b) an alkali metal salt of an organic acid,
a weight ratio of (b) the alkali metal salt of the organic acid to (a) the silica (a weight of (b)/a weight of (a)) being not less than 2.

[2] The lubricant composition for plastic working as described in [1], wherein (a) the silica is non-hollow silica.

[3] The lubricant composition for plastic working as described in [1] or [2], further containing (c) talc.

[4] The lubricant composition for plastic working as described in any one of [1] through [3], further containing (d) a water-soluble polymer.

[5] The lubricant composition for plastic working as described in any one of [1] through [4], further containing (e) a nonionic surfactant.

[6] The lubricant composition for plastic working as described in any one of [1] through [5], further containing (f) water.

[7] The lubricant composition for plastic working as described in any one of [3] through [6], wherein a weight ratio of (b) the alkali metal salt of the organic acid to (a) the silica and (c) the talc (the weight of (b)/{the weight of (a)+a weight of (c)}) is not less than 2.

Advantageous Effects of Invention

According to an aspect of the present invention, it is possible to provide a lubricant composition for plastic working which lubricant composition does not contaminate a working environment in black and which lubricant composition is excellent in lubricity and mold releasability.

DESCRIPTION OF EMBODIMENTS

The following description will discuss embodiments of the present invention in detail. Note, however, that the present invention is not limited to the embodiments, but can be altered by a skilled person in the art within the scope of the matters described. The present invention also encompasses, in its technical scope, any embodiment derived by combining technical means disclosed in differing embodiments. Note that a numerical range "A to B" means "not less than A and not more than B", unless otherwise specified herein.

[1. Lubricant Composition for Plastic Working]

A lubricant composition for plastic working in accordance with an embodiment of the present invention contains: (a) silica; and (b) an alkali metal salt of an organic acid, a weight ratio of (b) the alkali metal salt of the organic acid to (a) the silica (a weight of (b)/a weight of (a)) being not less than 2.

As used herein, a "lubricant composition for plastic working" intends a composition which is capable of being used as a lubricant that is used in a case where a workpiece material is subjected to plastic working. Note, here, that the workpiece material is not limited in particular, provided that the workpiece material can be subjected to the plastic working. For example, as the workpiece material, iron-based metal, such as a steel material, and non-ferrous metal, such as aluminum, are suitably used for plastic working. The plastic working is preferably carried out in a warm region or a hot region. Examples of the plastic working include forging, extrusion, rolling, pressing, wire drawing, and rotational molding such as spinning. Note, however, that the plastic working is not limited such examples. The lubricant composition in accordance with an embodiment of the present invention can be effectively used as, in particular, a mold lubricant for warm forging and hot forging. In a case where the lubricant composition in accordance with an embodiment of the present invention is used as a mold lubricant for warm forging and hot forging, the lubricant composition can be used in a way similar to a way of using a conventionally publicly known mold lubricant for warm forging and hot forging. A temperature range of the warm region and the hot region is 200° C. to 1250° C., and preferably 600° C. to 1250° C. Note that, herein, the "lubricant composition for plastic working in accordance with an embodiment of the present invention" will be also referred to as a "lubricant composition in accordance with an embodiment of the present invention".

As used herein, the expression "excellent in lubricity" intends that, by using a lubricant composition in a case where a workpiece material is worked on with use of a mold, it is possible to reduce friction between the mold and the workpiece material. This allows a reduction in abrasion of the mold, and allows obtainment of a better product through the plastic working. The lubricity can be evaluated by, for example, comparing lengths of axial elongations in a spike test later described in Examples. By using, for example, for forging, a lubricant composition which is excellent in lubricity, it is possible to obtain a forged product having an axial elongation longer than that of a forged product obtained with use of a lubricant composition which is poor in lubricity. The lubricity can be also evaluated by, for example, comparing pressing loads in the spike test later described in Examples. In a case where forging is carried out with use of a lubricant composition which is excellent in lubricity, it is possible to obtain a forged product by carrying out pressing with a pressing load smaller than that in a case where forging is carried out with use of a lubricant composition which is poor in lubricity.

As used herein, the expression "excellent in mold releasability" intends that, by using a lubricant composition in a case where a workpiece material is worked on with use of a mold, the workpiece material which has been worked on is removed from the mold without seizure of the workpiece material to the mold. The mold releasability can be evaluated by, for example, checking seizure and an axial luster of a workpiece material which has been worked on, in the spike test later described in Examples. In a case where seizure of a workpiece material to a mold occurs, the workpiece material which has been worked on has a luster. Therefore, in a case where a lubricant composition which is excellent in mold releasability is applied to a mold, seizure of a workpiece material to the mold is less likely to occur. Thus, a luster is not observed on the workpiece material which has been worked on.

The lubricant composition in accordance with an embodiment of the present invention may contain a component other than components (a) through (f) (later described), as necessary. Examples of such a component include dispersing agents, extreme pressure additives, metal corrosion inhibitors, preservatives, and defoaming agents.

[(a) Silica]

The lubricant composition in accordance with an embodiment of the present invention contains silica. According to the lubricant composition in accordance with an embodiment of the present invention, the silica is added so as to suppress seizure of a workpiece material to a mold and to improve mold releasability, under a severe environment of warm or hot plastic working of the workpiece material.

It is considered that a lubricating film obtained by spraying the lubricant composition under a severe environment of warm or hot plastic working is present on a surface of a mold as an aggregate in which individual components, that is, (a) the silica, (b) the alkali metal salt of the organic acid, and (d) a water-soluble polymer overlap each other. Generally, a melting point of silica is 1550° C. to 1750° C. Therefore, a heat-resistant, homogeneous, strong, and hard lubricating film is formed. In a case where (i) a workpiece material is pressed against such a lubricating film formed on a surface of a mold and (ii) a contact pressure which can cause a plastic deformation is applied to the workpiece material, individual components slide laterally on their interfaces. It is considered that this causes an improvement in following property of the lubricating film between the mold and the workpiece material and, consequently, a break in the lubricating film is prevented. This is a phenomenon similar to cleavage exhibited by a graphite-based lubricant. By this phenomenon, metal contact between the mold and the workpiece material is prevented. As a result, excellent lubricity and excellent mold releasability are achieved.

The silica can be any of natural crystalline silica, natural amorphous silica, synthetic crystalline silica, and synthetic amorphous silica. The synthetic amorphous silica can be synthesized by a dry method such as a combustion method and an arc method or can be alternatively synthesized by a wet method such as a sedimentation method, a gel method, and a sol-gel method. Note that, in addition to silicon dioxide, the silica may contain an impurity derived from a natural product such as aluminum oxide, ferric oxide, titanium oxide, magnesium oxide, calcium oxide, sodium oxide, and potassium oxide.

According to the lubricant composition in accordance with an embodiment of the present invention, the silica can be non-hollow silica, hollow silica, or a mixture thereof. From the viewpoint of achieving more excellent lubricity and more excellent mold releasability, the lubricant composition in accordance with an embodiment of the present invention preferably contains non-hollow silica, and more preferably contains only non-hollow silica. The lubricant composition in accordance with an embodiment of the present invention may contain plural kinds of silica which are different in mean particle size and/or the like. For example, in a case where the lubricant composition contains non-hollow silica as the silica, the lubricant composition may contain two or more kinds of non-hollow silica which are different in mean particle size. In a case where the lubricant composition contains hollow silica as the silica, the lubricant composition may contain two or more kinds of hollow silica which are different in mean particle size.

It is possible to understand that the lubricant composition in accordance with an embodiment of the present invention contains non-hollow silica, by observing the lubricant composition with use of a scanning electron microscope (magnification: 1000 times to 10000 times) and thereby confirming that each particle of the silica does not have a void inside.

It is possible to understand that the lubricant composition in accordance with an embodiment of the present invention contains hollow silica, by observing the lubricant composition with use of a scanning electron microscope (magnification: 1000 times to 10000 times) and thereby confirming that each particle of the silica has a void inside.

The silica has a mean particle size of preferably 0.1 μm to 60 μm, more preferably 0.2 μm to 30 μm, and still more preferably 0.5 μm to 10 μm. In a case where the silica has a mean particle size of 0.1 μm to 60 μm, the silica contained in the lubricant composition in accordance with an embodiment of the present invention does not aggregate and is appropriately dispersed. Furthermore, in a case where the silica has a mean particle size of 0.1 μm to 60 μm, a lubricating film formed on a surface of a mold by application of the lubricant composition in accordance with an embodiment of the present invention follows a workpiece material, between the mold and the workpiece material. This makes it possible to prevent metal contact. Note that it is possible to determine the mean particle size of the silica, as appropriate, by a known method. For example, it is possible to determine the mean particle size of the silica by (i) measuring, with use of a ruler, diameters of 50 particles of the silica which are observed under a microscope, (ii) correcting measured values with use of an observation magnification of the microscope, and (iii) calculating an average of the measured values thus corrected. Moreover, it is also possible to employ particle size distribution measurement by laser diffraction or particle size distribution measurement by Coulter counter and dynamic light scattering.

The silica is not limited in particular, and commercially available silica which has been conventionally publicly known can be used. Examples of commercially available non-hollow silica include NipSil available from Tosoh Silica Corporation and MIZUKASIL available from Mizusawa Industrial Chemicals, Ltd. Examples of commercially available hollow silica include SHIRAFAIN (registered trademark) available from Kabushikigaisha Igawa Sangyo.

In an embodiment of the present invention, the lubricant composition contains the silica in an amount of preferably 0.5% by weight to 8% by weight, more preferably 0.75% by weight to 7.5% by weight, and still more preferably 1% by weight to 6% by weight, with respect to 100% by weight of the lubricant composition. In a case where the amount of the silica is 0.5% by weight to 8% by weight with respect to 100% by weight of the lubricant composition, the silica is uniformly dispersed in the lubricant composition. This makes it possible to obtain a lubricant composition having a desired property. Moreover, a lubricating film formed on a surface of a mold follows a workpiece material, between the mold and the workpiece material. This makes it possible to prevent metal contact. Note that, in a case where the lubricant composition in accordance with an embodiment of the present invention contains plural kinds of silica which are different in mean particle size, the amount of the silica intends to a total weight of the plural kinds of silica.

In a case where the lubricant composition in accordance with an embodiment of the present invention contains both non-hollow silica and hollow silica, the lubricant composition contains the hollow silica in an amount of preferably less than 4.5% by weight, more preferably less than 4% by weight, still more preferably less than 3% by weight, even more preferably less than 2% by weight, particularly preferably less than 1.5% by weight, and most preferably less than 1.25% by weight, with respect to 100% by weight of the lubricant composition.

A weight ratio of the hollow silica to the non-hollow silica (a weight of the hollow silica/a weight of the non-hollow silica) is preferably not more than 0.5, more preferably not more than 0.25, and still more preferably not more than 0.1.

[(b) Alkali Metal Salt of Organic Acid]

The lubricant composition in accordance with an embodiment of the present invention contains an alkali metal salt of an organic acid. Since the lubricant composition in accordance with an embodiment of the present invention contains the alkali metal salt of the organic acid, the lubricant composition has improved lubricity.

Examples of the organic acid include: saturated carboxylic acids such as oxalic acid, malonic acid, succinic acid, malic acid, citric acid, adipic acid, azelaic acid, sebacic acid, dodecanedioic acid, 1,2-cyclohexanedicarboxylic acid, and hexahydrophthalic anhydride; unsaturated carboxylic acids such as fumaric acid, maleic acid, itaconic acid, 1,2,3,6-tetrahydrophthalic anhydride, 4-cyclohexene-1,2-dicarboxylic acid, 1-cyclohexene-1,2-dicarboxylic acid, and cyclohexene-1 and 2-dicarboxylic anhydride; aromatic carboxylic acids such as benzoic acid, salicylic acid, phthalic anhydride, phthalic acid, isophthalic acid, terephthalic acid, trimellitic acid, and naphtalenedicarboxylic acid. Examples of alkali metal include sodium and potassium. Specifically, the alkali metal and the organic acid form a salt by addition of sodium hydroxide, potassium hydroxide, or the like, and the organic acid is water-solubilized. Moreover, each of these components can be used alone or two or more of these components can be used in combination.

In an embodiment of the present invention, the lubricant composition for plastic working contains the alkali metal salt of the organic acid in an amount of preferably 15% by weight to 40% by weight, more preferably 15% by weight to 35% by weight, and still more preferably 17% by weight to 35% by weight, with respect to 100% by weight of the lubricant composition. It is considered that, in a case where the amount of the alkali metal salt of the organic acid is 15% by weight to 40% by weight with respect to 100% by weight of the lubricant composition for plastic working, the following property is improved between a mold and a workpiece material and, consequently, a break of the lubricating film is prevented. This is a phenomenon similar to cleavage of a graphite-based lubricant. By this phenomenon, excellent lubricity and excellent mold releasability are achieved.

The weight ratio of (b) the alkali metal salt of the organic acid to (a) the silica (the weight of (b)/the weight of (a)) is not less than 2, preferably not less than 3, more preferably not less than 4, and still more preferably not less than 5. In a case where the weight ratio of (b) the alkali metal salt of the organic acid to (a) the silica (the weight of (b)/the weight of (a)) is not less than 2, it is possible to realize a non-graphite-based lubricant composition for plastic working which lubricant composition is excellent in lubricity and mold releasability. In a case where the weight ratio of (b) the alkali metal salt of the organic acid to (a) the silica (the weight of (b)/the weight of (a)) satisfies the above preferable conditions, it is possible to disperse the silica, which is a solid component, better in the lubricant composition.

[(c) Talc]

The lubricant composition in accordance with an embodiment of the present invention may further contain talc. In a case where the lubricant composition contains talc, metal contact between a mold and a workpiece material is prevented, and excellent lubricity and excellent mold releasability are accordingly achieved.

An area of production of the talc, a kind of impurity, and the like are not limited in particular, and commercially available talc which has been conventionally publicly known can be used.

In an embodiment of the present invention, the lubricant composition for plastic working contains the talc in an amount of preferably 0.1% by weight to 10% by weight, more preferably 0.5% by weight to 8% by weight, and still more preferably 1% by weight to 5% by weight, with respect to 100% by weight of the lubricant composition. In a case where the amount of the talc is 0.1% by weight to 10% by weight with respect to 100% by weight of the lubricant composition for plastic working, a lubricating film formed on a surface of a mold follows a workpiece material, between the mold and the workpiece material. This makes it possible to prevent metal contact.

A weight ratio of (b) the alkali metal salt of the organic acid to (a) the silica and (c) the talc (the weight of (b)/{the weight of (a)+a weight of (c)}) is preferably not less than 2, more preferably not less than 3, and still more preferably not less than 4. In a case where the weight ratio of (b) the alkali metal salt of the organic acid to (a) the silica and (c) the talc (the weight of (b)/{the weight of (a)+the weight of (c)}) is not less than 2, the silica and the talc are uniformly dispersed in the lubricant composition. This makes it possible to obtain a lubricant composition having a desired property.

[(d) Water-Soluble Polymer]

The lubricant composition in accordance with an embodiment of the present invention may further contain a water-soluble polymer. The water-soluble polymer used in an embodiment of the present invention becomes thicker in a case where the water-soluble polymer is dissolved in water. This causes the water-soluble polymer to function as a binder component in a case where the lubricant composition in accordance with an embodiment of the present invention is sprayed onto a hot mold. It is therefore considered possible to improve sticking efficiency of (a) the silica, (b) the alkali metal salt of the organic acid, and (c) the talc. Accordingly, it is possible to obtain a lubricant composition which is excellent in sticking property and which forms a heat-resistant, homogeneous, strong, and hard lubricating film even under a severe environment of warm or hot plastic working.

As used herein, the expression "excellent in sticking property" intends that, in a case where a lubricant composition is applied to a surface of a mold, sticking efficiency of each component is improved and, at the same time, a lubricating film which firmly sticks to the surface of the mold is formed.

Examples of the water-soluble polymer include alkali metal salts of polymaleic acid-based resins, cellulose derivatives, and alkali metal salts of polyacrylic acids. Each of these can be used alone or two or more of these can be used in combination.

Examples of the polymaleic acid-based resins include polymers such as an isobutylene-maleic anhydride copolymer, a styrene-maleic anhydride copolymer, a methyl vinyl ether-maleic anhydride copolymer, and an α-methylstyrene-maleic anhydride copolymer. A polymer obtained by modifying any of these polymers with imide or ammonia can be also used. Examples of alkali metal include sodium and potassium. Specifically, the alkali metal and any of the polymaleic acid-based resins form a salt by addition of sodium hydroxide or potassium hydroxide, and the any of the polymaleic acid-based resins is water-solubilized. Moreover, each of these alkali metal salts of the polymaleic acid-based resins can be used alone or two or more of these alkali metal salts of the polymaleic acid-based resins can be used in combination.

Examples of the cellulose derivatives include hydroxyethylcellulose, sodium carboxymethylcellulose, and sodium hydroxymethylcellulose. Moreover, each of these cellulose derivatives can be used alone or two or more of these cellulose derivatives can be used in combination.

Examples of the alkali metal salts of the polyacrylic acids include sodium polyacrylate and potassium polyacrylate. The alkali metal salts of the polyacrylic acids can be commercially available ones that have been conventionally publicly known. The alkali metal salts of the polyacrylic acids each have an average molecular weight of preferably 1,000 to 5,000,000, more preferably 2,000 to 3,000,000, and still more preferably 3,000 to 1,000,000.

In an embodiment of the present invention, the lubricant composition for plastic working contains the water-soluble polymer in an amount of preferably 0.02% by weight to 30% by weight, more preferably 0.5% by weight to 25% by weight, and still more preferably 1% by weight to 20% by weight, with respect to 100% by weight of the lubricant composition. In a case where the amount of the water-soluble polymer is 0.02% by weight to 30% by weight with respect to 100% by weight of the lubricant composition for plastic working, the following advantages are brought about. That is, in a case where the lubricant composition in accordance with an embodiment of the present invention is applied to a surface of a mold, it is possible to improve sticking efficiency of each component and, at the same time, form a lubricating film which firmly sticks to the surface of the mold.

[(e) Nonionic Surfactant]

More preferably, the lubricant composition in accordance with an embodiment of the present invention further contains a nonionic surfactant.

The nonionic surfactant is not limited in particular. Polyoxyalkylene alkyl ether, polyoxyalkylene glycerine fatty acid ester, polyoxyalkylene sorbitan fatty acid ester, polyoxyalkylene polyglyceryl fatty acid ester, an alkylene glycol copolymer, or the like can be suitably used.

As the nonionic surfactant, a commercially available one that has been conventionally publicly known can be used.

In an embodiment of the present invention, the lubricant composition for plastic working contains the nonionic surfactant in an amount of preferably 0.01% by weight to 5% by weight, and more preferably 0.1% by weight to 5% by weight, with respect to 100% by weight of the lubricant composition. In a case where the amount of the nonionic surfactant is 0.01% by weight to 5% by weight with respect to 100% by weight of the lubricant composition for plastic working, it is possible to more uniformly dissolve and disperse solid components in the lubricant composition.

[(f) Water]

Preferably, the lubricant composition in accordance with an embodiment of the present invention further contains water.

The water is not limited in particular, provided that the water allows uniform dissolution or dispersion of each component. Note, however, that the water is preferably purified water such as ion exchanged water or pure water.

In an embodiment of the present invention, an amount of the water is preferably the rest after the amount of each component is subtracted from 100% by weight of the lubricant composition for plastic working.

[2. Method of Producing Lubricant Composition for Plastic Working, and Method of Using Lubricant Composition for Plastic Working]

In an embodiment of the present invention, the lubricant composition for plastic working is produced by mixing and stirring the above-described components.

According to the lubricant composition in accordance with an embodiment of the present invention, a preferable combination of the amounts of the components is not limited in particular, provided that the weight ratio of (b) the alkali metal salt of the organic acid to (a) the silica (the weight of (b)/the weight of (a)) is not less than 2. Examples of the preferable combination of the amounts of the components include the following combinations (A) through (E).

(A) With respect to 100% by weight of the lubricant composition for plastic working, the amount of (a) the silica is 0.5% by weight to 8% by weight; the amount of (b) the alkali metal salt of the organic acid is 15% by weight to 40% by weight; the amount of (d) the water-soluble polymer is 0.02% by weight to 30% by weight; the amount of (e) the nonionic surfactant is 0.01% by weight to 5% by weight; and the rest is (f) the water.

(B) With respect to 100% by weight of the lubricant composition for plastic working, the amount of (a) the silica is 0.75% by weight to 7.5% by weight; the amount of (b) the alkali metal salt of the organic acid is 15% by weight to 40% by weight; the amount of (d) the water-soluble polymer is 0.02% by weight to 30% by weight; the amount of (e) the nonionic surfactant is 0.01% by weight to 5% by weight; and the rest is (f) the water.

(C) With respect to 100% by weight of the lubricant composition for plastic working, the amount of (a) the silica is 0.75% by weight to 7.5% by weight; the amount of (b) the alkali metal salt of the organic acid is 15% by weight to 40% by weight; the amount of (d) the water-soluble polymer is 0.5% by weight to 25% by weight; the amount of (e) the nonionic surfactant is 0.01% by weight to 5% by weight; and the rest is (f) the water.

(D) With respect to 100% by weight of the lubricant composition for plastic working, the amount of (a) the silica is 0.75% by weight to 7.5% by weight; the amount of (b) the alkali metal salt of the organic acid is 15% by weight to 40% by weight; the amount of (d) the water-soluble polymer is 1% by weight to 20% by weight; the amount of (e) the nonionic surfactant is 0.01% by weight to 5% by weight; and the rest is (f) the water.

(E) With respect to 100% by weight of the lubricant composition for plastic working, the amount of (a) the silica is 1% by weight to 6% by weight; the amount of (b) the alkali metal salt of the organic acid is 15% by weight to 35% by weight; the amount of (d) the water-soluble polymer is 1% by weight to 20% by weight; the amount of (e) the nonionic surfactant is 0.01% by weight to 5% by weight; and the rest is (f) the water.

According to the lubricant composition in accordance with an embodiment of the present invention, a preferable combination of the amounts of the components in a case where the lubricant composition contains the talc is not limited in particular, provided that the weight ratio of (b) the alkali metal salt of the organic acid to (a) the silica and (c) the talc (the weight of (b)/{the weight of (a)+the weight of (c)}) is not less than 2. Examples of the preferable combination of the amounts of the components in a case where the lubricant composition contains the talc include the following combinations (F) through (J). (F) With respect to 100% by weight of the lubricant composition for plastic working, the amount of (a) the silica is 0.5% by weight to 8% by weight; the amount of (b) the alkali metal salt of the organic acid is 15% by weight to 40% by weight; the amount of (c) the talc is 0.1% by weight to 10% by weight; the amount of (d) the water-soluble polymer is 0.02% by weight to 30% by weight; the amount of (e) the nonionic surfactant is 0.01% by weight to 5% by weight; and the rest is (f) the water.

(G) With respect to 100% by weight of the lubricant composition for plastic working, the amount of (a) the silica is 0.75% by weight to 7.5% by weight; the amount of (b) the alkali metal salt of the organic acid is 15% by weight to 40% by weight; the amount of (c) the talc is 0.1% by weight to 10% by weight; the amount of (d) the water-soluble polymer is 0.02% by weight to 30% by weight; the amount of (e) the nonionic surfactant is 0.01% by weight to 5% by weight; and the rest is (f) the water.

(H) With respect to 100% by weight of the lubricant composition for plastic working, the amount of (a) the silica is 0.75% by weight to 7.5% by weight; the amount of (b) the alkali metal salt of the organic acid is 15% by weight to 40% by weight; the amount of (c) the talc is 0.1% by weight to 10% by weight; the amount of (d) the water-soluble polymer is 0.5% by weight to 25% by weight; the amount of (e) the nonionic surfactant is 0.01% by weight to 5% by weight; and the rest is (f) the water.

(I) With respect to 100% by weight of the lubricant composition for plastic working, the amount of (a) the silica is 0.75% by weight to 7.5% by weight; the amount of (b) the alkali metal salt of the organic acid is 15% by weight to 40% by weight; the amount of (c) the talc is 0.1% by weight to 10% by weight; the amount of (d) the water-soluble polymer is 1% by weight to 20% by weight; the amount of (e) the nonionic surfactant is 0.01% by weight to 5% by weight; and the rest is (f) the water.

(J) With respect to 100% by weight of the lubricant composition for plastic working, the amount of (a) the silica is 1% by weight to 6% by weight; the amount of (b) the alkali metal salt of the organic acid is 15% by weight to 35% by weight; the amount of (c) the talc is 1% by weight to 5% by weight; the amount of (d) the water-soluble polymer is 1% by weight to 20% by weight; the amount of (e) the nonionic surfactant is 0.01% by weight to 5% by weight; and the rest is (f) the water.

Note that, in the combinations (A) through (J), the lubricant composition in accordance with an embodiment of the present invention may contain a component other than (a) through (f), provided that the component does not adversely affect the effects of the present invention. Examples of such a component include dispersing agents, extreme pressure additives, metal corrosion inhibitors, preservatives, and defoaming agents.

The lubricant composition in accordance with an embodiment of the present invention can be used as a lubricant as it is or can be alternatively used after being diluted with water or the like. A dilution rate of the lubricant composition in accordance with an embodiment of the present invention can be adjusted, as appropriate, depending on the components used and an amount of the lubricant composition to be applied to a mold, and can be more than 30 times and not more than 100 times. As such, it is possible to increase the dilution rate as compared with a dilution rate of a conventional graphite-based or non-graphite-based mold lubricant which dilution rate is 10 times to 30 times. Thus, the lubricant composition is effective.

As a method of applying the lubricant composition in accordance with an embodiment of the present invention to a mold is not limit in particular, provided that it is possible to uniformly apply the lubricant composition to a surface of a mold. Examples of the method include spray atomization. In a case where the lubricant composition in accordance with an embodiment of the present invention is applied to a surface of a mold, a solution component such as the water evaporates by heat of the mold, so that a lubricating film is formed.

Examples of a workpiece material to which the lubricant composition in accordance with an embodiment of the present invention is applied include, but are not limited to, carbon steel, case-hardened steel, case-hardened alloy steel, and non-ferrous metal.

The present invention is not limited to the embodiments, but can be altered by a skilled person in the art within the scope of the claims. The present invention also encompasses, in its technical scope, any embodiment derived by combining technical means disclosed in differing embodiments.

EXAMPLES

The present invention will be described below in more detailed with reference to Examples. Note, however, that the present invention is not limited to such Examples.

[1. Preparation of Lubricant Composition]

Examples 1, 8, and 10

A solution was obtained by adding NaOH to water. While the solution was being heated and stirred at 40° C. to 100° C., an isobutylene-maleic anhydride copolymer was added to the solution and dissolved by a neutralization reaction. After the isobutylene-maleic anhydride copolymer was dissolved, NaOH was further added to a resultant solution. While the solution was being heated and stirred at 40° C. to 100° C., an organic acid was added to the solution and dissolved by a neutralization reaction. A resultant aqueous solution was cooled to an ordinary temperature. A nonionic surfactant and silica were further added to the aqueous solution. A resultant aqueous solution was sufficiently stirred and mixed. In Examples 8 and 10, talc was subsequently added to the aqueous solution, and a resultant aqueous solution was mixed. A lubricant composition for plastic working was thus prepared. Note that amounts of components blended are as shown in Table 1, and a unit of a numerical value indicating each of the amounts of the components is "% by weight".

Examples 2 through 7, 9, 13, and 14

A solution was obtained by adding NaOH to water. While the solution was being heated and stirred at 40° C. to 100° C., an organic acid was added to the solution and dissolved by a neutralization reaction. After the organic acid was dissolved, hydroxyethylcellulose was added to a resultant solution. While the solution was being heated and stirred at 40° C. to 100° C., the hydroxyethylcellulose was dissolved. A resultant aqueous solution was cooled to an ordinary temperature to obtain the solution. A nonionic surfactant (Examples other than Examples 3, 6, and 7) and silica were added to the solution, and a resultant solution was sufficiently stirred and mixed. In Examples 9, talc was subsequently added to the solution, and a resultant solution was mixed. A lubricant composition for plastic working was thus prepared. Note that amounts of components blended are as shown in Table 1, and a unit of a numerical value indicating each of the amounts of the components is "% by weight".

Examples 11 and 12

Sodium polyacrylate was added to water, and a resultant solution was mixed. Subsequently, NaOH was added to the solution. While a resultant solution was being heated and stirred at 40° C. to 100° C., an isobutylene-maleic anhydride copolymer was added to the solution and dissolved by a neutralization reaction. After the isobutylene-maleic anhydride copolymer was dissolved, NaOH was further added to a resultant solution. While a resultant solution was being heated and stirred at 40° C. to 100° C., an organic acid was added to the solution and dissolved by a neutralization reaction. A resultant aqueous solution was cooled to an ordinary temperature. Furthermore, silica was added to the aqueous solution, and a resultant aqueous solution was sufficiently stirred and mixed. A lubricant composition for plastic working was thus prepared. Note that amounts of components blended are as shown in Table 1, and a unit of a numerical value indicating each of the amounts of the components is "% by weight".

By a procedure similar to the above-described procedure, components were introduced, and lubricant compositions of Comparative Examples 1 to 20 and Reference Example 1 were each prepared. Note that amounts of the components blended are as shown in Tables 2 and 3, and a unit of a numerical value indicating each of the amounts of the components is "% by weight". Details of each of the components are as follows.

<(a) Component (Silica)>

Silica I: NipSil E-220A (production method: precipitation, amorphous silica, melting point 1710° C., mean particle size 1.5 μm) available from Tosoh Silica Corporation Silica II: MIZUKASIL P-527 (production method: wet method, amorphous silica, melting point 1600° C. to 1750° C., mean particle size 2.0 μm) available from Mizusawa Industrial Chemicals, Ltd.

Silica-alumina hollow body (hollow silica): SHIRAFAIN ISM-035M (mean particle size 35 μm) available from Kabushikigaisha Igawa Sangyo <(b) Component (Alkali Metal Salt of Organic Acid)>

As has been described, NaOH was added to water to obtain a solution. While the solution was being heated and stirred at 40° C. to 100° C., an organic acid was added to the solution and an alkali metal salt of the organic acid was prepared by a neutralization reaction.

Disodium adipate (adipic acid available from BASF Japan Ltd. was neutralized)

Disodium isophthalate (isophthalic acid available from LOTTE CHEMICAL CORPORATION was neutralized)

Disodium phthalate (phthalic anhydride available from Kawasaki Kasei Chemicals Ltd. was neutralized)

Disodium terephthalate (terephthalic acid available from Mizushima Aroma Co., Ltd. was neutralized)

<(c) Component (Talc)>

Talc: MISTRON 850JS (mean particle size 5.0 μm) available from Nippon Silica Industries <(d) Component (Water-Soluble Polymer)>

Sodium salt of isobutylene-maleic anhydride copolymer (ISOBAM 10 available from Kuraray Co. Ltd. was neutralized)

Hydroxyethylcellulose: SP-200 available from Daicel Fine-Chem Ltd.

Sodium polyacrylate: ARON A-210 available from Toagosei Co., Ltd.

<(e) Component (Nonionic Surfactant)>

NOIGEN: LF-60X (polyoxyalkylene alkyl ether) available from DKS Co., Ltd.

<(f) Component (Water)>

Water: ion exchanged water

<(g) Component (Alkali Metal Salt of Inorganic Acid)>

Potassium sulfate: Wako Pure Chemical Industries

Sodium carbonate: Wako Pure Chemical Industries

<(h) Component>

Calcium carbonate: HAKUENKA T-DD (primary particle size 80 nm) available from Shiraishi Calcium Kaisha. Ltd.

Melamine cyanurate MC-6000 (mean particle size 2.0 μm) available from Nissan Chemical Corporation Mica: Repco Mica M-XF (mean particle size 3.0 μm) available from Repco Inc.

Boron nitride: YINGKOU LIAOBIN METICULOUS CHEMICAL CO., LTD (mean particle size 1.0 μm)

Graphite-based lubricant: AS-6 available from Nippon Kokuen Kogyo Kabushikigaisha

[2. Evaluation Test]

<Axial Elongation>

Lubricity was evaluated by a spike test. Test conditions were set as follows.

Each of lubricant compositions shown in Tables 1 through 3 was diluted with water at a dilution rate of 40 times. Subsequently, each of the lubricant compositions was sprayed onto a mold for a spike test which mold was heated to 150° C., at a spray pressure of 0.3 MPa, from a spray distance of 300 mm, and at a rate of 4 cc/10 Osec. Thereafter, a test piece which was heated to 1200° C. was set on the mold, and was pressed with use of a 100 t hydraulic press (manufactured by Komatsu Industries Corp.) A height (axial elongation) of the test piece thus molded was measured. Tables 1 through 3 show results.

<Pressing Load>

A pressing load at a time when the test piece was pressed as described above was measured. Tables 1 through 3 show results.

<Seizure to Mold>

Whether or not seizure of the test piece to the mold occurred when the test piece was molded as described above was evaluated in accordance with the following criteria. With this evaluation, it is possible to evaluate whether each of the lubricant compositions is excellent in mold releasability. Tables 1 through 3 show results.

Excellent: A molded test piece was removed from a mold without seizure of the molded test piece to the mold. Poor: Seizure of a molded test piece to a mold occurred and the molded test piece was not removed from the mold.

<Axial Luster>

A surface of the test piece molded as described above was observed, and evaluated in accordance with the following criteria. With this evaluation, it is possible to evaluate whether each of the lubricant compositions is excellent in mold releasability. Tables 1 through 3 show results.

Excellent: No luster was observed on a surface of a molded test piece.

Poor: A luster was observed on a surface of a molded test piece.

TABLE 1

| Amount (% by weight) | | EX 1 | EX 2 | EX 3 | EX 4 | EX 5 | EX 6 | EX 7 | EX 8 | EX 9 | EX 10 | EX 11 | EX 12 | EX 13 | EX 14 |
|---|---|---|---|---|---|---|---|---|---|---|---|---|---|---|---|
| (a) Component | Silica I | 4 | 4 | 2 | 2 | 2 | 2 | — | 1 | 1 | 2 | 2 | — | — | — |
| | Silica II | — | — | — | — | — | — | 2 | — | — | — | — | 2 | — | — |
| | Silica-alumina hollow body | — | — | — | — | — | — | — | — | — | — | — | — | 2 | 4 |
| (b) Component | Disodium adipate | 26 | 4 | 8 | 22.6 | 4 | 4 | 4 | 26 | 4 | 26 | — | — | 4 | 4 |
| | Disodium isophthalate | — | 18.6 | 23 | — | 18.6 | 18.6 | 18.6 | — | 18.6 | — | — | — | 18.6 | 18.6 |
| | Disodium phthalate | — | — | — | — | — | — | — | — | — | — | 14.3 | 14.3 | — | — |
| | Disodium terephthalate | — | — | — | — | — | — | — | — | — | — | 3.4 | 3.4 | — | — |
| (c) Component | Talc | — | — | — | — | — | — | — | 3 | 3 | 2 | — | — | — | — |
| (d) Component | Sodium salt of isobutylene-maleic anhydride copolymer | 6 | — | — | — | — | — | — | 6 | — | 6 | 6.9 | 6.9 | — | — |
| | Hydroxyethylcellulose | — | 2.2 | 2.2 | 2.2 | 2.2 | 2.2 | 2.2 | — | 2.2 | — | — | — | 2.2 | 2.2 |
| | Sodium polyacrylate | — | — | — | — | — | — | — | — | — | — | 2.4 | 2.4 | — | — |
| (e) Component | NOIGEN | 0.1 | 0.1 | — | 0.1 | 0.1 | — | — | 0.1 | 0.1 | 0.1 | — | — | 0.1 | 0.1 |
| (f) Component | Water | the rest | the rest | the rest | the rest | the rest | the rest | the rest | the rest | the rest | the rest | the rest | the rest | the rest | the rest |
| (g) Component | Potassium sulfate | — | — | — | — | — | — | — | — | — | — | — | — | — | — |
| | Sodium carbonate | — | — | — | — | — | — | — | — | — | — | — | — | — | — |
| (h) Component | Calcium carbonate | — | — | — | — | — | — | — | — | — | — | — | — | — | — |
| | Melamine cyanurate | — | — | — | — | — | — | — | — | — | — | — | — | — | — |
| | Mica | — | — | — | — | — | — | — | — | — | — | — | — | — | — |
| | Boron nitride | — | — | — | — | — | — | — | — | — | — | — | — | — | — |
| | Graphite-based lubricant | — | — | — | — | — | — | — | — | — | — | — | — | — | — |
| | (b)/(a) | 6.50 | 5.65 | 15.50 | 11.30 | 11.30 | 11.30 | 11.30 | 26.00 | 22.60 | 13.00 | 8.86 | 8.86 | 11.30 | 5.65 |
| | (b)/{(a) + (c)} or (b)/(h) | 6.50 | 5.65 | 15.50 | 11.30 | 11.30 | 11.30 | 11.30 | 6.50 | 5.65 | 6.50 | 8.86 | 8.86 | 11.30 | 5.65 |
| Test result | Seizure to mold | E | E | E | E | E | E | E | E | E | E | E | E | E | E |
| | Axial luster | E | E | E | E | E | E | E | E | E | E | E | E | E | E |
| | Axial elongation (mm) | 17.77 | 17.98 | 18.02 | 17.62 | 18.04 | 17.74 | 17.93 | 17.61 | 18.10 | 17.70 | 18.10 | 18.34 | 17.51 | 17.50 |
| | Pressing load (t) | 66 | 71 | 67 | 73 | 71 | 67 | 68 | 70 | 69 | 71 | 68 | 74 | 74 | 75 |

"EX" stands for "Example".

"E" stands for "Excellent".

TABLE

| Amount (% by weight) | | CEX 1 | CEX 2 | CEX 3 | CEX 4 | CEX 5 | CEX 6 | CEX 7 | CEX 8 |
|---|---|---|---|---|---|---|---|---|---|
| (a) Component | Silica I | 10 | 15 | 20 | 20 | — | — | — | — |
| | Silica II | — | — | — | — | — | — | — | — |
| | Silica-alumina hollow body | — | — | — | — | — | — | — | — |
| (b) Component | Disodium adipate | 2.7 | 1.8 | — | — | 4 | 26 | 4 | — |
| | Disodium isophthalate | 12.3 | 8.2 | — | — | 18.6 | — | 18.6 | — |
| | Disodium phthalate | — | — | — | — | — | — | — | — |
| | Disodium terephthalate | — | — | — | — | — | — | — | — |
| (c) Component | Talc | — | — | — | — | 2 | 4 | 4 | 10 |
| (d) Component | Sodium salt of isobutylene-maleic anhydride copolymer | — | — | 6 | — | — | 6 | — | 6 |
| | Hydroxyethylcellulose | 2.2 | 2.2 | — | 2.2 | 2.2 | — | 2.2 | — |
| | Sodium polyacrylate | — | — | — | — | — | — | — | — |
| (e) Component | NOIGEN | 0.1 | 0.1 | 0.1 | 0.1 | 0.1 | 0.1 | 0.1 | 0.1 |
| (f) Component | Water | the rest | the rest | the rest | the rest | the rest | the rest | the rest | the rest |
| (g) Component | Potassium sulfate | — | — | — | — | — | — | — | 10 |
| | Sodium carbonate | — | — | — | — | — | — | — | — |
| (h) Component | Calcium carbonate | — | — | — | — | — | — | — | — |
| | Melamine cyanurate | — | — | — | — | — | — | — | — |
| | Mica | — | — | — | — | — | — | — | — |
| | Boron nitride | — | — | — | — | — | — | — | — |
| | Graphite-based lubricant | — | — | — | — | — | — | — | — |
| | (b)/(a) | 1.50 | 0.67 | — | — | — | — | — | — |
| | (b)/{(a) + (c)} or (b)/(h) | 1.50 | 0.67 | — | — | 11.30 | 6.50 | 5.65 | — |
| Test result | Seizure to mold | P | P | P | P | P | P | P | P |
| | Axial luster | P | P | P | P | E | P | P | P |
| | Axial elongation (mm) | 17.55 | 15.56 | 15.81 | 15.71 | 18.06 | 17.90 | 17.50 | 17.03 |
| | Pressing load (t) | 80 | >90 | >90 | >90 | 68 | 71 | 75 | 85 |

| Amount (% by weight) | | CEX 9 | CEX 10 | CEX 11 | CEX 12 | CEX 13 | CEX 14 |
|---|---|---|---|---|---|---|---|
| (a) Component | Silica I | — | — | — | — | — | — |
| | Silica II | — | — | — | — | — | — |
| | Silica-alumina hollow body | — | 10 | 20 | — | — | — |
| (b) Component | Disodium adipate | — | 2.7 | — | 4 | 26 | — |
| | Disodium isophthalate | — | 12.3 | — | 18.6 | — | — |
| | Disodium phthalate | — | — | — | — | — | — |
| | Disodium terephthalate | — | — | — | — | — | — |
| (c) Component | Talc | 20 | — | — | — | — | — |
| (d) Component | Sodium salt of isobutylene-maleic anhydride copolymer | 6 | — | 6 | — | 6 | 6 |
| | Hydroxyethylcellulose | — | 2.2 | — | 2.2 | — | — |
| | Sodium polyacrylate | — | — | — | — | — | — |
| (e) Component | NOIGEN | 0.1 | 0.1 | 0.1 | 0.1 | 0.1 | 0.1 |
| (f) Component | Water | the rest | the rest | the rest | the rest | the rest | the rest |
| (g) Component | Potassium sulfate | — | — | — | — | — | — |
| | Sodium carbonate | — | — | — | — | — | — |
| (h) Component | Calcium carbonate | — | — | — | 2 | 4 | 20 |
| | Melamine cyanurate | — | — | — | — | — | — |
| | Mica | — | — | — | — | — | — |
| | Boron nitride | — | — | — | — | — | — |
| | Graphite-based lubricant | — | — | — | — | — | — |
| | (b)/(a) | — | 1.50 | — | — | — | — |
| | (b)/{(a) + (c)} or (b)/(h) | — | 1.50 | — | 11.30 | 6.50 | — |
| Test result | Seizure to mold | P | P | P | P | P | P |
| | Axial luster | P | P | P | P | P | P |
| | Axial elongation (mm) | 16.33 | 15.74 | 16.15 | 17.48 | 17.26 | 16.45 |
| | Pressing load (t) | >90 | >90 | >90 | 71 | 78 | 89 |

"CEX" stands for "Comparative Example".

"E" stands for "Excellent".

"P" stands for "Poor".

TABLE 3

| Amount (% by weight) | | CEX 15 | CEX 16 | CEX 17 | CEX 18 | CEX 19 | CEX 20 | REX 1 |
|---|---|---|---|---|---|---|---|---|
| (a) Component | Silica I | — | — | — | — | — | — | — |
| | Silica II | — | — | — | — | — | — | — |
| | Silica-alumina hollow body | — | — | — | — | — | — | — |
| (b) Component | Disodium adipate | 4 | 4 | 4 | 4 | 28.9 | 4.5 | — |
| | Disodium isophthalate | 18.6 | 18.6 | 18.6 | 18.6 | — | 20.6 | — |
| | Disodium phthalate | — | — | — | — | — | — | — |
| | Disodium terephthalate | — | — | — | — | — | — | — |
| (c) Component | Talc | — | — | — | — | — | — | — |
| (d) Component | Sodium salt of isobutylene-maleic anhydride copolymer | — | — | — | — | 6.7 | — | — |
| | Hydroxyethylcellulose | 2.2 | 2.2 | 2.2 | 2.2 | — | 2.5 | — |
| | Sodium polyacrylate | — | — | — | — | — | — | — |
| (e) Component | NOIGEN | 0.1 | 0.1 | 0.1 | 0.1 | — | — | — |
| (f) Component | Water | the rest | the rest | the rest | the rest | the rest | the rest | the rest |
| (g) Component | Potassium sulfate | — | — | — | — | — | — | — |
| | Sodium carbonate | — | — | — | 2 | — | — | — |
| (h) Component | Calcium carbonate | — | — | — | — | — | — | — |
| | Melamine cyanurate | 2 | — | — | — | — | — | — |
| | Mica | — | 2 | — | — | — | — | — |
| | Boron nitride | — | — | 2 | — | — | — | — |
| | Graphite-based lubricant | — | — | — | — | — | — | Solid content: 30% |
| | (b)/(a) | — | — | — | — | — | — | — |
| (b)/{(a) + (c)} or (b)/(h) | | 11.30 | 11.30 | 11.30 | — | — | — | — |
| Test result | Seizure to mold | P | P | P | P | P | P | E |
| | Axial luster | P | P | P | P | P | P | E |
| | Axial elongation (mm) | 17.50 | 17.20 | 17.72 | 17.42 | 16.87 | 17.44 | 17.46 |
| | Pressing load (t) | 72 | 77 | 63 | 78 | 82 | 82 | 65 |

"CEX" stands for "Comparative Example".
"REX" stands for "Reference Example".
"E" stands for "Excellent".
"P" stands for "Poor".

From the results of Examples 1 through 7 and Examples 11 through 14, it is found that use of silica and an alkali metal salt of an organic acid allows obtainment of a non-graphite-based lubricant composition which has excellent lubricity and excellent mold releasability that are comparable to those of a graphite-based lubricant composition of Reference Example 1.

Moreover, from a comparison between the result of Example 2 and the result of Example 14 and a comparison between the result of Example 5 and the result of Example 13, it is found that, as compared with use of hollow silica, use of non-hollow silica allows obtainment of a non-graphite-based lubricant composition which has more excellent lubricity and more excellent mold releasability.

Furthermore, from the results of Examples 8 through 10, it is found that use of silica, an alkali metal salt of an organic acid, and talc also allows obtainment of a non-graphite-based lubricant composition which has excellent lubricity and excellent mold releasability that are comparable to those of the graphite-based lubricant composition of Reference Example 1.

In contrast, from the results of Comparative Examples 1, 2, and 10, it is found that, even in a case where silica and an alkali metal salt of an organic acid are used, it is not possible to obtain a non-graphite-based lubricant composition which has excellent lubricity and excellent mold releasability, unless a weight ratio of the alkali metal salt of the organic acid to the silica is not less than 2.

From the results of Comparative Examples 3, 4, and 11, it is found that, in a case where an alkali metal salt of an organic acid is not used, it is not possible to obtain a non-graphite-based lubricant composition which has excellent lubricity and excellent mold releasability.

From the results of Comparative Examples 5 through 9, it is found that, in a case where talc is used without use of silica, it is not possible to obtain a non-graphite-based lubricant composition which has excellent lubricity and excellent mold releasability.

From the results of Comparative Examples 12 through 14, it is found that, in a case where calcium carbonate is used instead of silica, it is not possible to obtain a non-graphite-based lubricant composition which has excellent lubricity and excellent mold releasability. Moreover, from the results of Comparative Examples 12 and 13, it is found that, even in a case where a weight of an alkali metal salt of an organic acid with respect to calcium carbonate is not less than 2, it is not possible to obtain a non-graphite-based lubricant composition which has excellent lubricity and excellent mold releasability.

From the result of Comparative Example 15, it is found that, in a case where melamine cyanurate is used instead of silica, it is not possible to obtain a non-graphite-based lubricant composition which has excellent lubricity and excellent mold releasability, even in a case where a weight ratio of an alkali metal salt of an organic acid to the melamine cyanurate is not less than 2.

From the result of Comparative Example 16, it is found that, in a case where mica is used instead of silica, it is not possible to obtain a non-graphite-based lubricant composition which has excellent lubricity and excellent mold releasability, even in a case where a weight ratio of an alkali metal salt of an organic acid to the mica is not less than 2.

From the result of Comparative Example 17, it is found that, in a case where boron nitride is used instead of silica, it is not possible to obtain a non-graphite-based lubricant composition which has excellent lubricity and excellent mold releasability, even in a case where a weight ratio of an alkali metal salt of an organic acid to the boron nitride is not less than 2.

From the results of Comparative Examples 18 through 20, it is found that, in a case where silica is not used, it is not possible to obtain a non-graphite-based lubricant composition which has excellent lubricity and excellent mold releasability.

From the above, it is found that, in a case where (i) silica and an alkali metal salt of an organic acid are used and (ii) a weight ratio of the alkali metal salt of the organic acid to the silica is not less than 2, it is possible to obtain a non-graphite-based lubricant composition which has excellent lubricity and excellent mold releasability.

INDUSTRIAL APPLICABILITY

The present invention can be used as a lubricant in a case where metal is subjected to plastic working in a warm region or a hot region.

The invention claimed is:

1. A lubricant composition for plastic working, comprising:

(a) silica;

(b) an alkali metal salt of an organic acid; and (c) a water-soluble polymer, a weight ratio of (b) the alkali metal salt of the organic acid to (a) the silica (a weight of (b)/a weight of (a)) being not less than 2;

(b) the alkali metal salt of the organic acid is an alkali metal salt of an aliphatic carboxylic acid and/or an alkali metal salt of an aromatic carboxylic acid, wherein (a) the silica is non-hollow silica, and the lubricant composition for plastic working is a non-emulsion composition.

2. The lubricant composition for plastic working as set forth in claim 1, further comprising (d) talc.

3. The lubricant composition for plastic working as set forth in claim 1, further comprising (e) a nonionic surfactant.

4. The lubricant composition for plastic working as set forth in claim 1, further comprising (f) water.

5. The lubricant composition for plastic working as set forth in claim 2, wherein a weight ratio of (b) the alkali metal salt of the organic acid to (a) the silica and (d) the talc (the weight of (b)/{the weight of (a)+a weight of (d)}) is not less than 2.

6. A lubricant composition for plastic working comprising:

(a) silica;

(b) an alkali metal salt of an organic acid;

(c) a water-soluble polymer (e) a nonionic surfactant; and (f) water, a weight ratio of (b) the alkali metal salt of the organic acid to (a) the silica (a weight of (b)/a weight of (a)) being not less than 2;

the lubricant composition for plastic working is a non-emulsion composition;

(b) the alkali metal salt of the organic acid is an alkali metal salt of an aliphatic carboxylic acid and/or an alkali metal salt of an aromatic carboxylic acid, wherein (a) the silica is non-hollow silica, and with respect to 100% by weight of the lubricant composition for plastic working, an amount of (a) the silica is 0.5% by weight to 8% by weight;

an amount of (b) the alkali metal salt of the organic acid is 15% by weight to 40% by weight;

an amount of (c) a water-soluble polymer is 0.02% by weight to 30% by weight;

an amount of (e) the nonionic surfactant is 0.01% by weight to 5% by weight; and a rest is (f) the water.

7. The lubricant composition for plastic working as set forth in claim 6, further comprising:

(d) talc, wherein with respect to 100% by weight of the lubricant composition for plastic working, an amount of (d) the talc is 0.1% by weight to 10% by weight.

8. The lubricant composition for plastic working as set forth in claim 7, wherein a weight ratio of (b) the alkali metal salt of the organic acid to (a) the silica and (d) the talc (the weight of (b)/{the weight of (a)+a weight of (d)}) is not less than 2.

* * * * *